US010874273B2

(12) United States Patent
Han et al.

(10) Patent No.: US 10,874,273 B2
(45) Date of Patent: Dec. 29, 2020

(54) VACUUM CLEANER

(71) Applicant: LG Electronics Inc., Seoul (KR)

(72) Inventors: Seonghoon Han, Seoul (KR); Kuyoung Son, Seoul (KR); Chungill Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 315 days.

(21) Appl. No.: 15/762,230

(22) PCT Filed: Sep. 21, 2016

(86) PCT No.: PCT/KR2016/010549
§ 371 (c)(1),
(2) Date: Mar. 22, 2018

(87) PCT Pub. No.: WO2017/052205
PCT Pub. Date: Mar. 30, 2017

(65) Prior Publication Data

US 2018/0271344 A1 Sep. 27, 2018

(30) Foreign Application Priority Data

Sep. 22, 2015 (KR) ..... 10-2015-0133727

(51) Int. Cl.
*A47L 9/28* (2006.01)
*A47L 5/12* (2006.01)

(52) U.S. Cl.
CPC ..... *A47L 9/2842* (2013.01); *A47L 5/12* (2013.01); *A47L 9/28* (2013.01); *A47L 9/2857* (2013.01); *A47L 9/2884* (2013.01)

(58) Field of Classification Search
CPC . A47L 9/2842; A47L 9/28; A47L 5/12; A47L 9/2857; A47L 9/2884
See application file for complete search history.

(56) References Cited

FOREIGN PATENT DOCUMENTS

| | | |
|---|---|---|
| DE | 102007027902 | 12/2008 |
| JP | S62298329 | 12/1987 |
| JP | 2003-219991 | 8/2003 |
| KR | 10-2006-0118796 | 11/2006 |

(Continued)

OTHER PUBLICATIONS

International Search Report and Written Opinion in International Application No. PCT/KR2016/010549, dated Jan. 16, 2017, 19 pages (with English translation).

(Continued)

*Primary Examiner* — David Redding
(74) *Attorney, Agent, or Firm* — Fish & Richardson P.C.

(57) ABSTRACT

The present invention relates to a vacuum cleaner. The vacuum cleaner of the present invention comprises: a cleaner body having a suction motor for generating suctioning force, and running in operating mode and charging mode; a suctioning part communicating with the cleaner body, for suctioning air and dust; a battery assembly capable of supplying power to the suction motor and having a plurality of battery packs; a controller for controlling the operation of the suction motor; a current regulating unit for regulating the current applied to the suction motor in a state in which the plurality of battery packs are serially connected; a first switching mechanism for serially connecting the plurality of battery packs; and a second switching mechanism for parallelly connecting the plurality of battery packs.

19 Claims, 9 Drawing Sheets

(56) References Cited

FOREIGN PATENT DOCUMENTS

| | | |
|---|---|---|
| KR | 10-2007-0024749 | 3/2007 |
| KR | 10-2012-0128898 | 11/2012 |
| KR | 10-2014-0068833 | 6/2014 |
| KR | 10-1552437 | 9/2015 |

OTHER PUBLICATIONS

Extended European Search Report in European Application No. 16848930.0, dated Mar. 26, 2019, 7 pages.

VACUUM CLEANER

CROSS-REFERENCE TO RELATED APPLICATIONS

This application is a National Stage application under 35 U.S.C. § 371 of International Application No. PCT/KR2016/010549, filed Sep. 21, 2016, which claims the benefit of Korean Application No. 10-2015-0133727, filed on Sep. 22, 2015. The disclosures of the prior applications are incorporated by reference in their entirety.

TECHNICAL FIELD

The present invention relates to a vacuum cleaner.

BACKGROUND ART

In general, vacuum cleaners are devices that suction air containing dust by using suction force generated by a suction motor mounted in a main body to filter the dust in the main body.

Vacuum cleaners are classified into manual cleaners and automatic cleaners. The manual cleaners are cleaners that are used for directly performing cleaning by a user, and the automatic cleaners that travel by oneself to perform cleaning.

The manual cleaners may be classified into a canister type cleaner in which a suction nozzle is provided separately with respect to a main body and connected to the main body by using a connection tube and an upright type cleaner in which a suction nozzle is coupled to a main body.

A power cord outlet of a cleaner is disclosed in Korean Patent Publication No. 10-2006-0118796 (Published Date: Nov. 24, 2006) that is a prior art document 1.

According to the prior art document 1, since a cord reel assembly is provided in a main body, and a power cord is connected to a socket, the main body may receive power.

In the prior art document 1, since a cleaner receives power through the cord reel assembly, the cleaner may move by only a distance corresponding to a length of the cord wound around the cord reel assembly when the cleaner performs cleaning.

A vacuum cleaner is disclosed in Korean Patent Publication No. 10-2008-0105847 (Published Date: Dec. 4, 2008) that is a prior art document 2.

The vacuum cleaner according to the prior art document 2 includes a main body including a battery and a charger and a cord reel assembly separably connected to the main body.

The vacuum cleaner may connect the main body to the cord reel assembly to receive commercial power and charge the battery. When the cord reel assembly is separated from the main body, the vacuum cleaner may receive DC power of the battery to operate.

In the prior art document 2, when the vacuum cleaner receives power from the battery to operate, a use time may be limited due to the limitation in charging capacity of the battery. Particularly, if the cleaner operates in a state in which suction force is maximized, an operation time may be remarkably reduced.

DISCLOSURE OF THE INVENTION

Technical Problem

An object of the present invention is to provide a vacuum cleaner that increases in a time at which cleaning is enabled.

Another object of the present invention is to provide a vacuum cleaner that increases in intensity of suction force of a suction motor.

Further another object of the present invention is to provide a vacuum cleaner that is easy to charge a battery.

Technical Solution

A vacuum cleaner according to an aspect of the present invention includes: a cleaner body including a suction motor for generating suction force and operating in an operating mode and a charging mode; a suctioning part communicating with the cleaner body to suction air and dust; a battery assembly supplying power to the suction motor and including a plurality of battery packs; a controller controlling an operation of the suction motor; a current regulating unit regulating current applied to the suction motor in a state in which the plurality of battery packs are connected in series to each other; a first switching mechanism serially connecting the plurality of battery packs to each other; and a second switching mechanism parallely connecting the plurality of battery packs to each other.

The operating mode may include a plurality of modes, and the controller may control one or more of the first switching mechanism, the second switching mechanism, and the current regulating unit on the basis of the selected mode of the plurality of modes.

The plurality of modes may include a first mode, a second mode, and a third mode.

In the first mode, the controller may turn off the first switching mechanism and turn on the second switching mechanism, In the second mode, the controller may turn on the first switching mechanism and turn off the second switching mechanism, and the current regulating unit may regulate current applied to the suction motor.

In the third mode, the controller may turn on the first switching mechanism and turn off the second switching mechanism, ad the current regulating unit may not operate.

The vacuum cleaner may further include a user interface for selecting one mode of the plurality of modes.

The plurality of battery packs may be connected in parallel or series to each other by a command inputted by the user interface.

When a portion of the plurality of battery packs is not mounted on the cleaner body in the state in which the second mode or the third mode is selected, mounting notification information or error information of the battery pack may occur in the user interface.

When a portion of the plurality of battery packs is not mounted on the cleaner body in the state in which the second mode or the third mode is selected, notification information or error information of the battery pack may occur in the user interface.

In the second mode, the current regulating unit may reduce current applied to the suction motor when compared with a case in which one battery pack is mounted.

In the third mode, the current applied to the suction motor may be constantly maintained.

The second switching mechanism may include: a first switch connects a negative electrode terminal to both ends of one battery pack of the plurality of battery packs or block the connection between the negative electrode terminal and the one battery pack; a second switch connects one battery pack of the plurality of battery packs to both ends of a positive electrode terminal for charging or block the connection between the one battery pack and the positive electrode terminal; and a third switch connects both ends of the plurality of battery packs to each other or block the connection between the plurality of battery packs.

A diode for blocking a flow of current flowing from the battery pack having a high voltage to the battery pack having a low voltage in the first mode may be provided in each of the battery packs.

The vacuum cleaner may further include a charger provided in the cleaner body to charge a portion or the whole of the plurality of battery packs.

A portion of the plurality of battery packs may be maintained in a state of being fixed to the cleaner body, and the other portion may be separable from the cleaner body.

The battery pack fixed to the cleaner body may have a charging capacity greater than that of the battery pack that is separable from the cleaner body.

Each of the battery packs may include a plurality of battery cells, and the number of battery cells of the battery pack fixed to the cleaner body may be greater than that of battery cells of the battery pack that is separable from the cleaner body.

The vacuum cleaner may further include a mounting part, on which the plurality of battery packs are individually mounted, on the cleaner body, wherein a mounting guide for guiding the mounting of each of the plurality of battery packs may be disposed on the mounting part.

The plurality of battery packs mounted on the mounting part may be spaced apart from each other by the mounting guide.

Advantageous Effects

According to the proposed invention, since the power is supplied from the battery assembly to the suction motor, the vacuum cleaner may be improved in degree of freedom.

That is, since the vacuum cleaner does not include the cord reel around which the power cord is wound and receives the power from the battery assembly, the vacuum cleaner may not be limited in the movement distance thereof. Also, while the vacuum cleaner moves, it may be unnecessary to move over the power cord wound around the cord reel or arrange the cord. Thus, the vacuum cleaner may smoothly move.

Also, since a portion or the whole of the plurality of battery packs are separable from the cleaner body, the battery cell may be easily replaced, and the battery pack may be easily charged.

Also, since the cleaner body is operable even though only a portion of the plurality of battery packs is mounted, the possibility of use of the cleaner body may be improved.

Also, since the plurality of battery packs are connected in parallel to each other in the state in which the plurality of battery packs are mounted on the cleaner body, the available time of the cleaner body may increase.

Also, when the plurality of battery packs are connected in series to each other in the state in which the plurality of battery packs are mounted on the cleaner body, and the current is adjustable, the operation efficiency of the suction motor may be improved, and thus, the available time of the battery may increase.

Also, when the plurality of battery packs are connected to each other in series in the state in which the plurality of battery packs are mounted on the cleaner body to constantly maintain the current, the output of the suction motor may increase, and thus, the suction force may increase.

MODE FOR CARRYING OUT THE INVENTION

Figure 1:
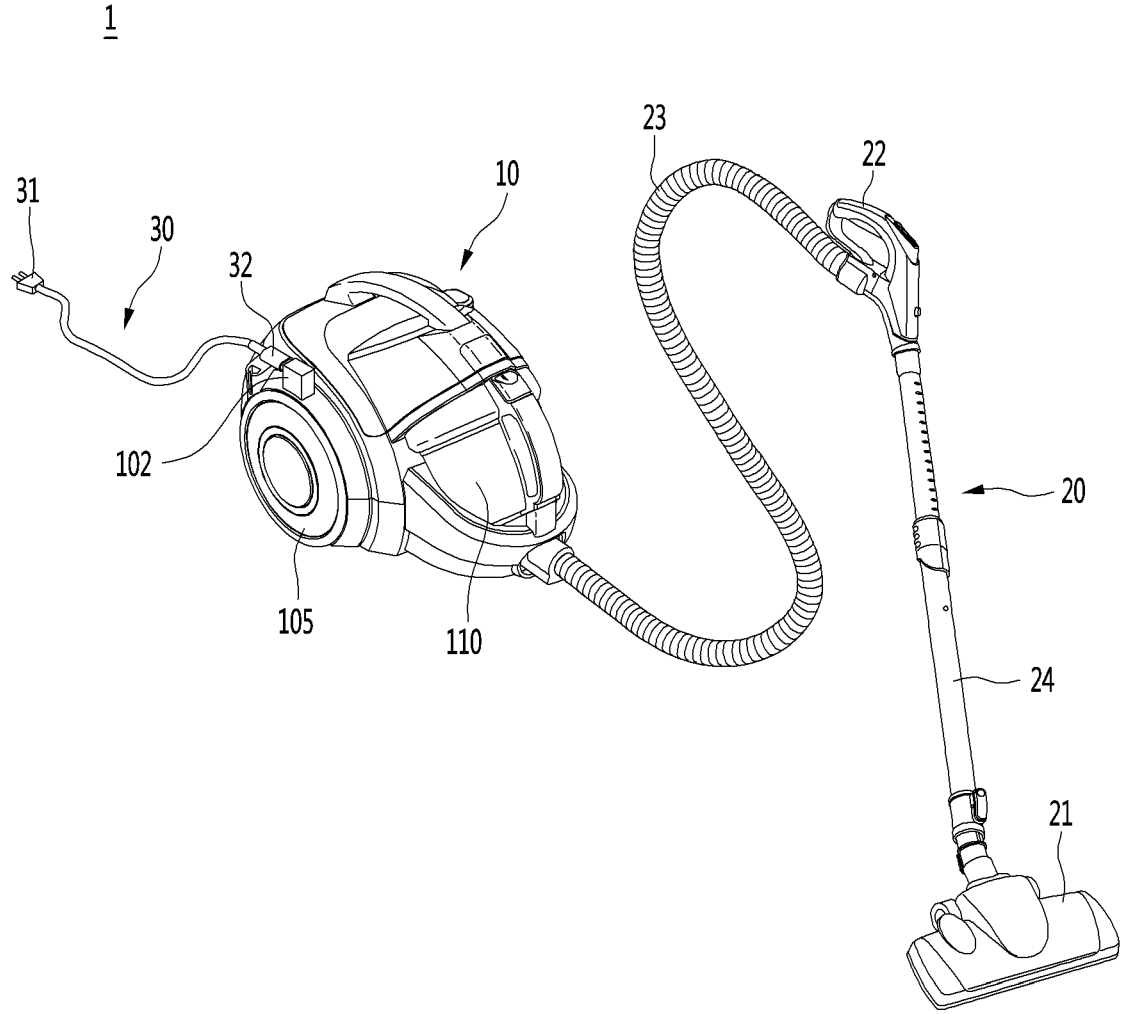
FIG. 1 is a perspective view of a vacuum cleaner according to an embodiment.

Hereinafter, embodiments of the present invention will be described in detail with reference to the accompanying drawings. It is noted that the same or similar components in the drawings are designated by the same reference numerals as far as possible even if they are shown in different drawings. In the following description of the present invention, a detailed description of known functions and configurations incorporated herein will be omitted to avoid making the subject matter of the present invention unclear.

In the description of the elements of the present invention, the terms first, second, A, B, (a), and (b) may be used. However, since the terms are used only to distinguish an element from another, the essence, sequence, and order of the elements are not limited by them. When it is described that an element is "coupled to", "engaged with", or "connected to" another element, it should be understood that the element may be directly coupled or connected to the other element but still another element may be "coupled to", "engaged with", or "connected to" the other element between them.

Figure 2:
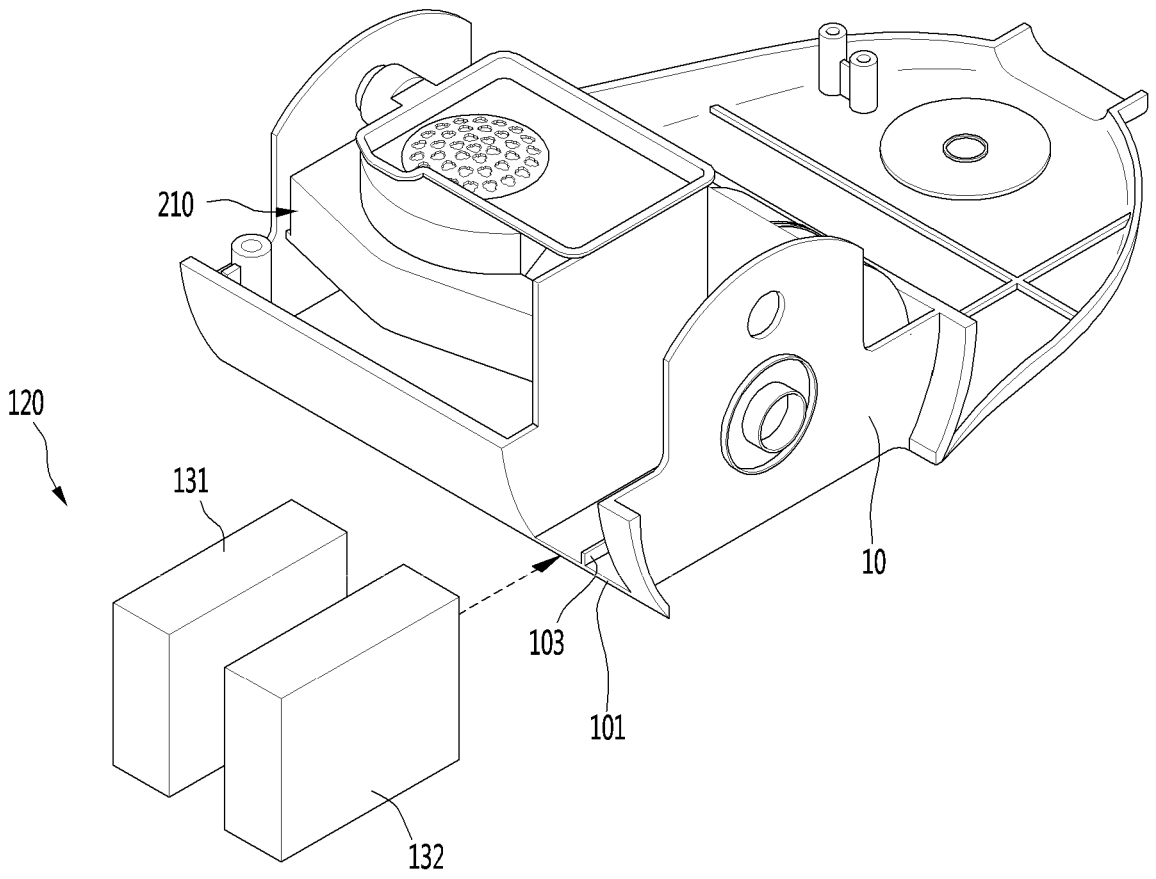
FIG. 2 is a view illustrating a state in which a plurality of battery assembles are separated from the vacuum cleaner according to an embodiment.
Figure 3:
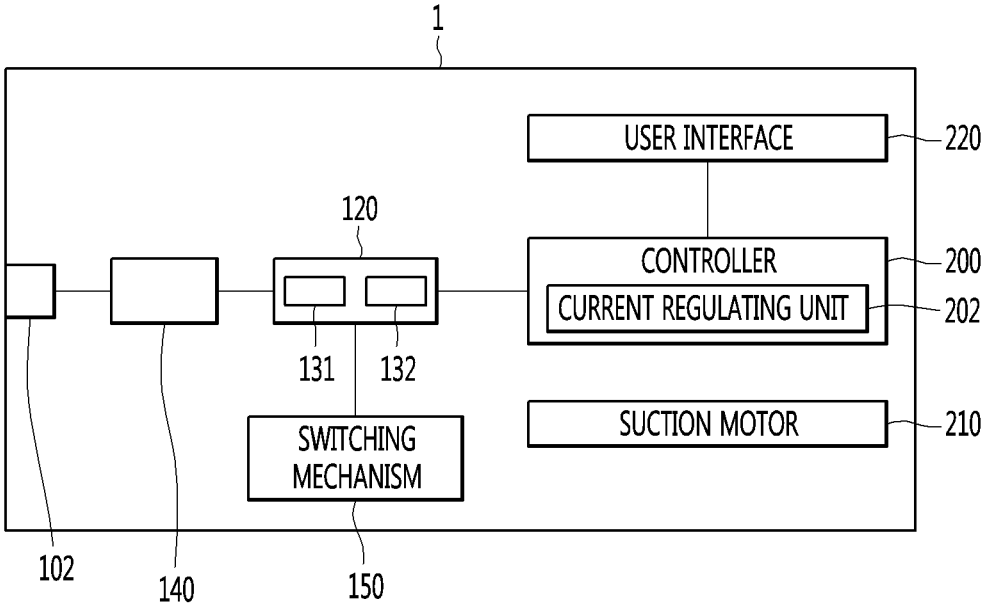
FIG. 3 is a block diagram of the vacuum cleaner according to an embodiment.

FIG. 1 is a perspective view of a vacuum cleaner according to an embodiment, FIG. 2 is a view illustrating a state in which a plurality of battery assembles are separated from the vacuum cleaner according to an embodiment, and FIG. 3 is a block diagram of the vacuum cleaner according to an embodiment.

Referring to FIGS. 1 to 3, a vacuum cleaner 1 according to an embodiment may include a cleaner body 10 including a suction motor 210 for generating suction force and a suction device 20 for guiding air containing dust to the cleaner body 10.

The suction device 20 may include a suctioning part 21 for suctioning dust disposed on a surface to be cleaned, for example, a bottom surface and connection parts 22, 23, and 24 for connecting the suctioning part 21 to the cleaner body 10.

The connection part 22, 23, and 24 may include an extension tube 24 connected to the suctioning part 21, a handle connected to the extension tube 24, and a suction hose 23 connecting the handle 22 to the cleaner body 10.

Also, the vacuum cleaner 1 may further include a dust separation part (not shown) for separating dust from air suctioned by the suction device 20 and a dust container 110 for storing the dust separated by the dust separation part. The dust container 110 may be separably mounted on the cleaner body 10. The dust separation part may be provided as a separate part that is separated from the dust container 110, be provided as one module together with the dust container 110, or be disposed in the dust container 110.

The vacuum cleaner 1 may further include a battery assembly 120 supplying power for operating the suction motor 210 and a controller 200 for controlling the suction motor 210.

The battery assembly 120 may include a first battery pack 131 and a second battery pack 132.

Each of the battery packs 131 and 132 may include a plurality of battery cells. The plurality of battery cells may be chargeable and dischargeable secondary batteries. The battery cells constituting each of the battery packs 131 and 132 may be connected in series to each other.

A mounting part 101 may be disposed on the cleaner body 10, and one or more of the plurality of battery packs 131 and 132 may be separably mounted on the mounting part 101.

For example, all of the plurality of battery packs 131 and 132 may be individually separably mounted on the mounting part 101.

In this case, as necessary, one or two or more battery packs 131 and 132 may be separated from the mounting part 101.

For example, the plurality of battery packs 131 and 132 may be mounted on the mounting part 101 in a sliding manner. In this case, a mounting guide 103 for guiding the mounting of each of the battery packs 131 and 132 may be disposed on the mounting part 101.

The mounting guide 103 may allow the plurality of battery packs 131 and 132 to be spaced apart from each other in the state in which the plurality of battery packs 131 and 132 are mounted on the mounting part 101.

Thus, in the plurality of battery packs 131 and 132, heat generated from each of the battery packs 131 and 132 may be minimally affected to other battery packs in the state in which the plurality of battery packs 131 and 132 are mounted on the mounting part 101.

For another example, a spacer (not shown) for spacing the plurality of battery packs 131 and 132 apart from each other in the state in which the plurality of battery packs 131 and 132 are mounted on the mounting part 101 may be disposed on the mounting part 101 in addition to the mounting guide 103.

Alternatively, a portion of the plurality of battery packs 131 and 132 may be fixed to the mounting part 101, and the other portion may be separable from the mounting part 101.

In this case, since some battery pack is fixed to the mounting part 101, event through the other battery pack is separated from the mounting part 101, the vacuum cleaner 1 may be operable as long as a usable remaining voltage exists in the some battery pack.

The battery packs 131 and 132 may have the same charging capacity or different charging capacities.

Here, if only a portion of the battery packs 131 and 132 is separable from the cleaner body 10, the charging capacity of the battery pack fixed to the cleaner body 10 among the battery packs 131 and 132 may be greater than that of the battery pack that is separable from the cleaner body 10.

For example, the number of battery cells of the battery pack fixed to the cleaner body 10 among the battery packs 131 and 132 may be greater than that of battery cells of the battery pack that is separable from the cleaner body 10.

A cover member (not shown) covering the battery assembly 120 may be disposed on the cleaner body 10. Since the cover member is separated from the cleaner body 10, a portion or the whole of the plurality of battery packs 131 and 132 may be separable from the mounting part 101. Alternatively, the cover member may be rotatably or slidably connected to the cleaner body 10.

The battery assembly 120 may be disposed between the suction motor 210 and a wheel 105 for moving the cleaner body 10.

The vacuum cleaner 1 may further include a charger for charging the battery assembly 120 and a power cord 30 separably connected to the cleaner body 10 and supplying commercial power into the cleaner body 10.

The power cord 30 may include a plug 31 connected to a socket and a cord connector 32 connected to the cleaner body 10. Also, the cleaner body 10 may include a body connector 102 connected to the cord connector 32.

The wheel 105 may be disposed on each of both sides of the cleaner body 10. Although is not limited, the body connector 102 may be disposed above the wheel 105 that is disposed at one side.

The charger 140 may charge the battery pack mounted on the cleaner body 10 even though a portion of the battery packs is separated from the cleaner body 10.

According to this embodiment, the suction motor 210 may receive power from the battery assembly 120. Thus, in this embodiment, a cord reel around which the power cord is wound may be omitted. Thus, the vacuum cleaner 1 may be improved in degree of freedom.

That is, since the vacuum cleaner 1 does not include the cord reel and receives power from the battery assembly 120, the vacuum cleaner 1 is not limited in a movement distance thereof. While the vacuum cleaner 1 moves, it may be unnecessary to move over a cord wound around the cord reel or arrange the cord. Thus, the vacuum cleaner 1 may smoothly move.

Also, according to this embodiment, since a portion or the whole of the plurality of battery packs 131 and 132 are separable from the cleaner body 10, the battery cells provided in each of the battery packs 131 and 132 may be easily replaced.

Particularly, since the battery assembly 120 includes the plurality of battery packs 131 and 132, a portion or the whole of the plurality of battery packs 131 and 132 may be individually replaced.

The vacuum cleaner 1 may further include a user interface 220. The user interface 220 may receive an operation command of the vacuum cleaner 1 and display operation information or state information of the vacuum cleaner 1.

The user interface 220 may be disposed on at least one of the handle 22 and the body 10. The user interface 220 may be provided in a shape in which an input unit and a display unit are integrated with each other or include an input unit and a display unit which are separately provided.

A power-on selection, a cleaning mode, and an intensity of the suction force of the vacuum cleaner 1 may be selected through the input unit. The display unit may display residual power information of at least the battery assembly 120.

When a residual power amount of battery assembly 120 reaches a reference value, the controller 200 may control the display unit so that information for informing request of the charging of the battery assembly 120 is displayed on the display unit.

For another example, the display unit may continuously or gradationally display the residual power amount of battery assembly 120. For example, the display unit may display the residual power amount of battery assembly 120 by using a figure or symbol or a graph shape. Alternatively, the display unit may include a plurality of light emitting parts to display the residual power amount of battery assembly 120 by changing the number of light emitting parts that are turned on. Alternatively, the display unit may display the residual power amount of battery assembly 120 by changing a color of light emitted from a light emitting part.

The controller 200 may include a current regulating unit regulating current applied to the suction motor 210.

The vacuum cleaner 1 may further include a switching mechanism 150 operating to be switched according to the number of mounted battery packs 131 and 132 or connection modes. The switching mechanism 150 will be described below with reference to the accompanying drawings.

Figure 4:
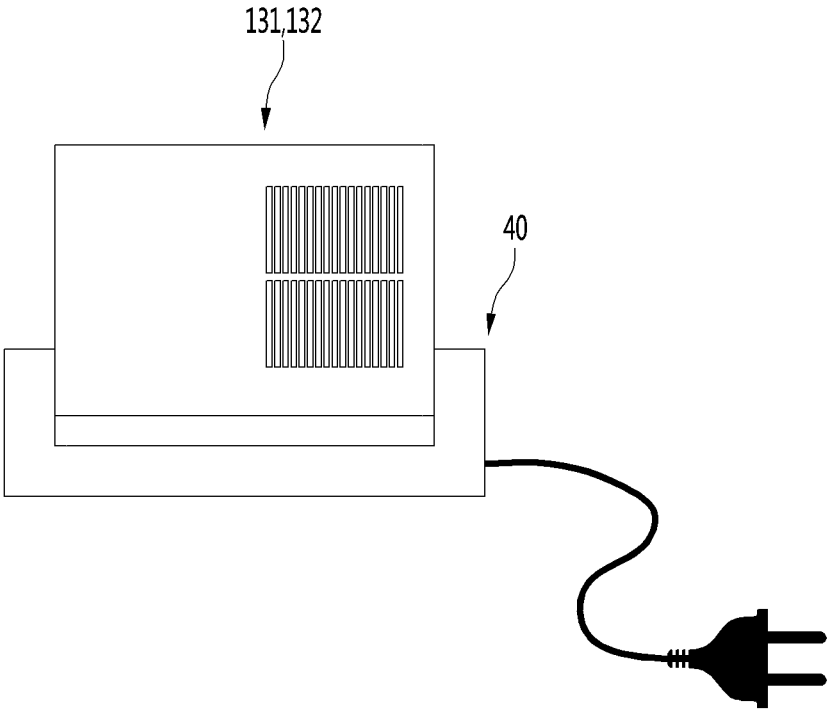
FIG. 4 is a view illustrating a state in which a battery pack is separated from a cleaner body and seated on a charging stand.

FIG. 4 is a view illustrating a state in which the battery pack is separated from the cleaner body and seated on the charging stand.

Referring to FIGS. 3 and 4, the battery packs 131 and 132 that are separated from the cleaner body 10 may be seated on the charging stand 40.

Here, when the plurality of battery packs 131 and 132 are separable from the cleaner body 10, the plurality of battery packs 131 and 132 separated from the cleaner body 10 may be seated on the charging stand at the same time.

Also, when the battery packs 131 and 133 are seated on the charging stand, the battery packs 131 and 132 may be changed.

Thus, the user may connect the vacuum cleaner 1 to the power cord 30 to charge the battery packs 131 and 132. After the battery packs 131 and 132 are separated from the cleaner body 10, the battery packs 131 and 132 may be seated on the charging stand to charge the battery packs 131 and 132, thereby improving user's convenience for charging the battery packs 131 and 132.

Figure 5:
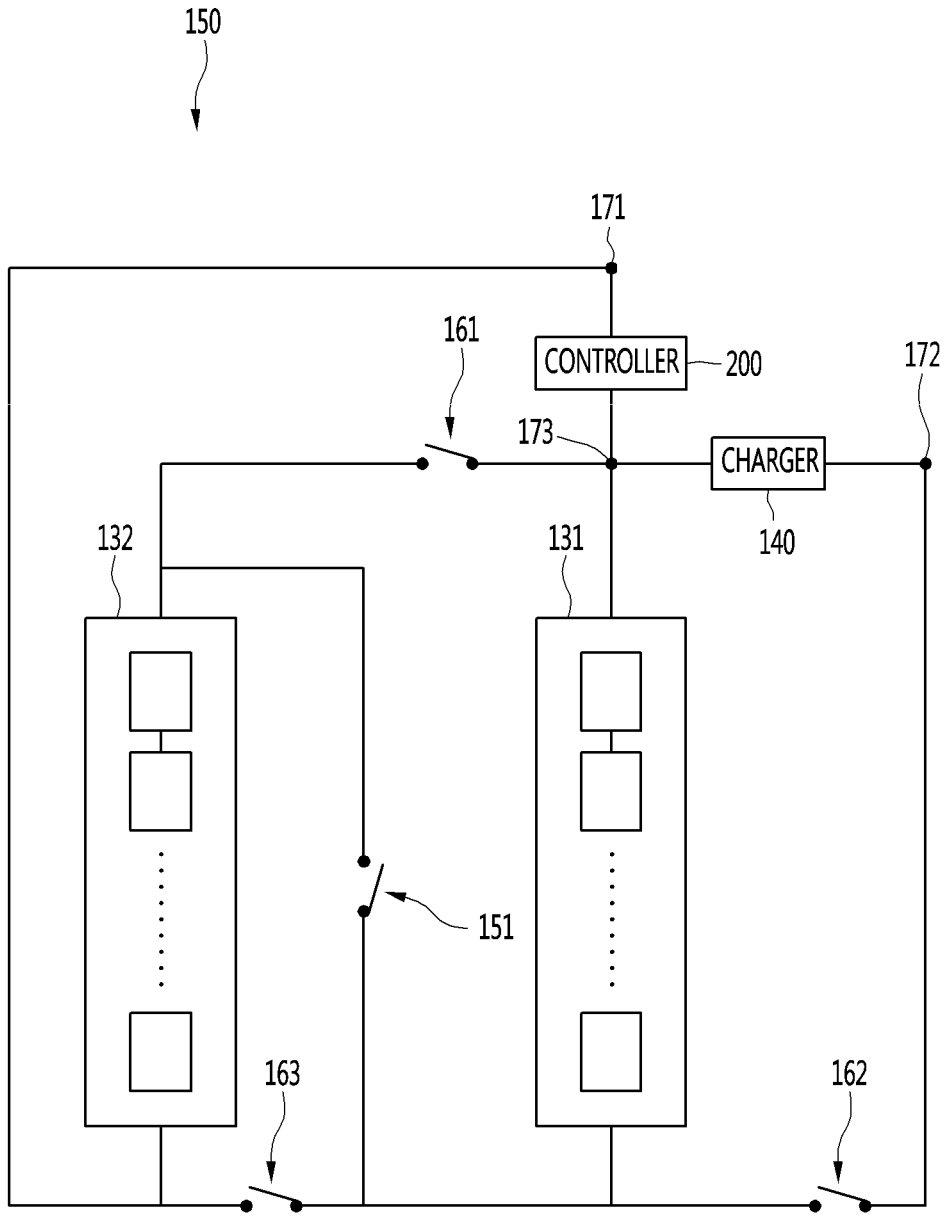
FIG. 5 is a view of a switching mechanism according to an embodiment of the present invention.

FIG. 5 is a view of the switching mechanism according to an embodiment of the present invention.

Referring to FIG. 5, the switching mechanism 150 may include a first switching mechanism 151 (or a serial switch) for serially connecting the battery packs 131 and 132 to each other and second switching mechanisms 161, 162, and 163 (or parallel switches) for parallely connecting the battery packs 131 and 132 to each other.

The second switching mechanisms 161, 162, and 163 may include a first switch 161, a second switch 162, and a third switch 163.

The first switch 161 may connect a negative electrode terminal 173 to both ends of one battery pack of the plurality of battery packs 131 and 132, for example, a second battery pack 132 or block the connection between the negative electrode terminal 173 and the second battery pack 132.

The second switch 162 may connect both ends of one battery pack of the plurality of battery packs 131 and 132, for example, a first battery pack 131 to both ends of a positive electrode terminal 172 for charging or block the connection between the first battery pack 131 and the positive electrode terminal 172.

The third switch 163 may connect both ends (the same polarity) of the first battery pack 131 and the second battery pack 132 to each other or block the connection between the first battery pack 131 and the second battery pack 132.

Each of the switches 161, 162, and 163 may be connected to the controller 200 to receive a control signal from the controller 200 and thereby to perform a switching operation.

The first switching mechanism 151 may connect both ends (polarities different from each other) of the first battery pack 131 and the second battery pack 132 to each other or block the connection between the first and second battery packs 131 and 132.

The first switching mechanism 151 may be connected to the controller 200 to receive a control signal from the controller 200 and thereby to perform a switching operation.

Figure 6:
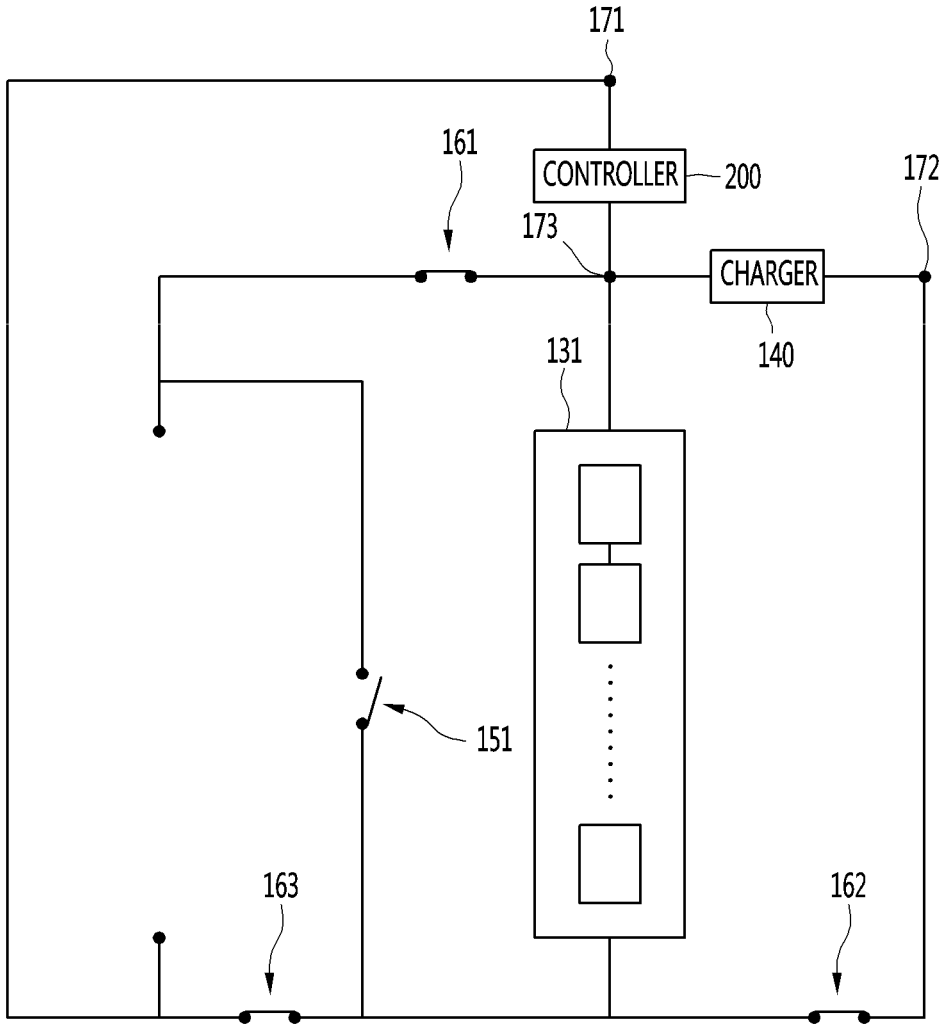
FIG. 6 is a view illustrating a state in which a first battery pack is mounted on the cleaner body, and a second battery pack is separated from the cleaner body according to an embodiment.
Figure 7:
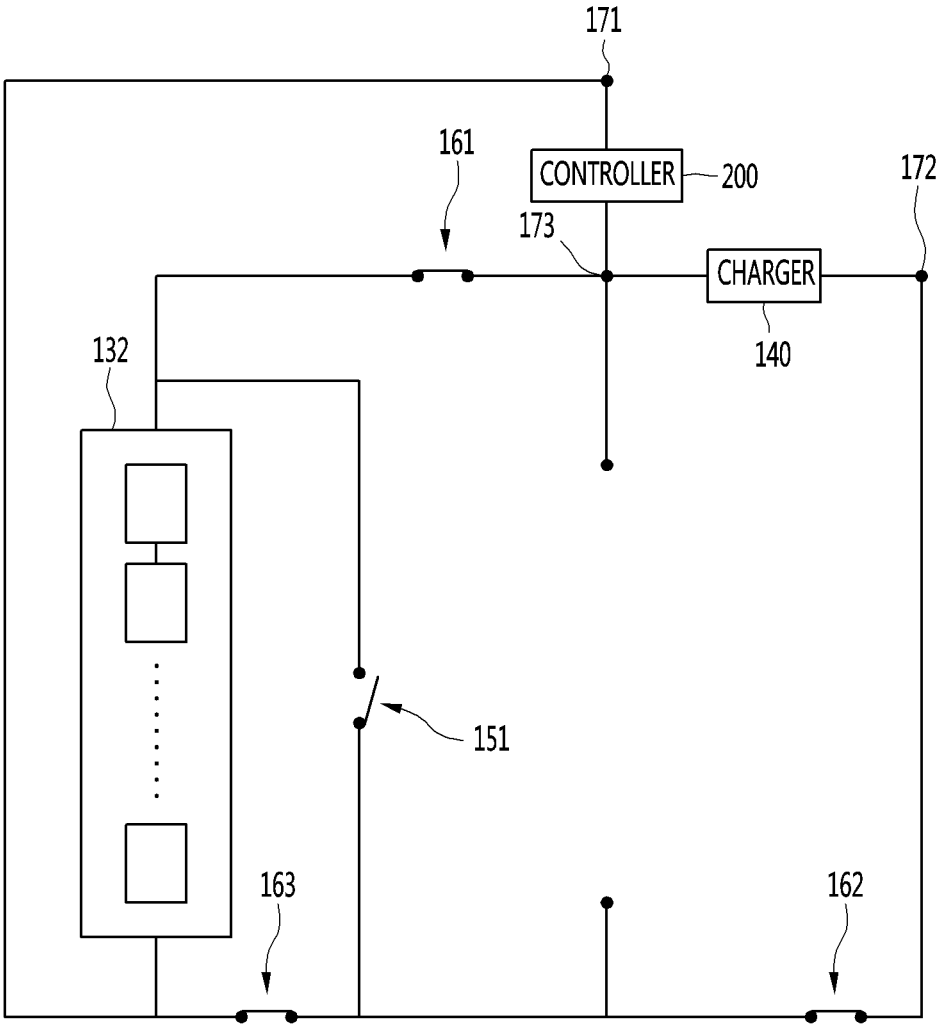
FIG. 7 is a view illustrating a state in which the second battery pack is mounted on the cleaner body, and the first battery pack is separated from the cleaner body according to an embodiment.

FIG. 6 is a view illustrating a state in which the first battery pack is mounted on the cleaner body, and the second battery pack is separated from the cleaner body according to an embodiment, and FIG. 7 is a view illustrating a state in which the second battery pack is mounted on the cleaner body, and the first battery pack is separated from the cleaner body according to an embodiment.

Referring to FIGS. 6 and 7, although a portion of the plurality of battery packs 131 and 132 is mounted on the cleaner body 10, and the other portion is separated from the cleaner body 10, the cleaner body 10 may operate by the power supplied from some battery pack.

Also, a portion of the battery packs, which is mounted on the cleaner body 10, may be changed. Here, the battery pack separated from the cleaner body 10 may be seated on the charging stand and be charged.

Particularly, in the state in which only a portion of the plurality of battery packs 131 and 132 is mounted on the cleaner body 10, the controller 200 may turn on the first switching mechanism 151 and turn off the second switching mechanisms 161, 162, and 163.

In this case, although only a portion of the plurality of battery packs 131 and 132 is mounted on the cleaner body 10, the cleaner body 10 may operate, and the portion of the battery packs may be charged.

Figure 8:
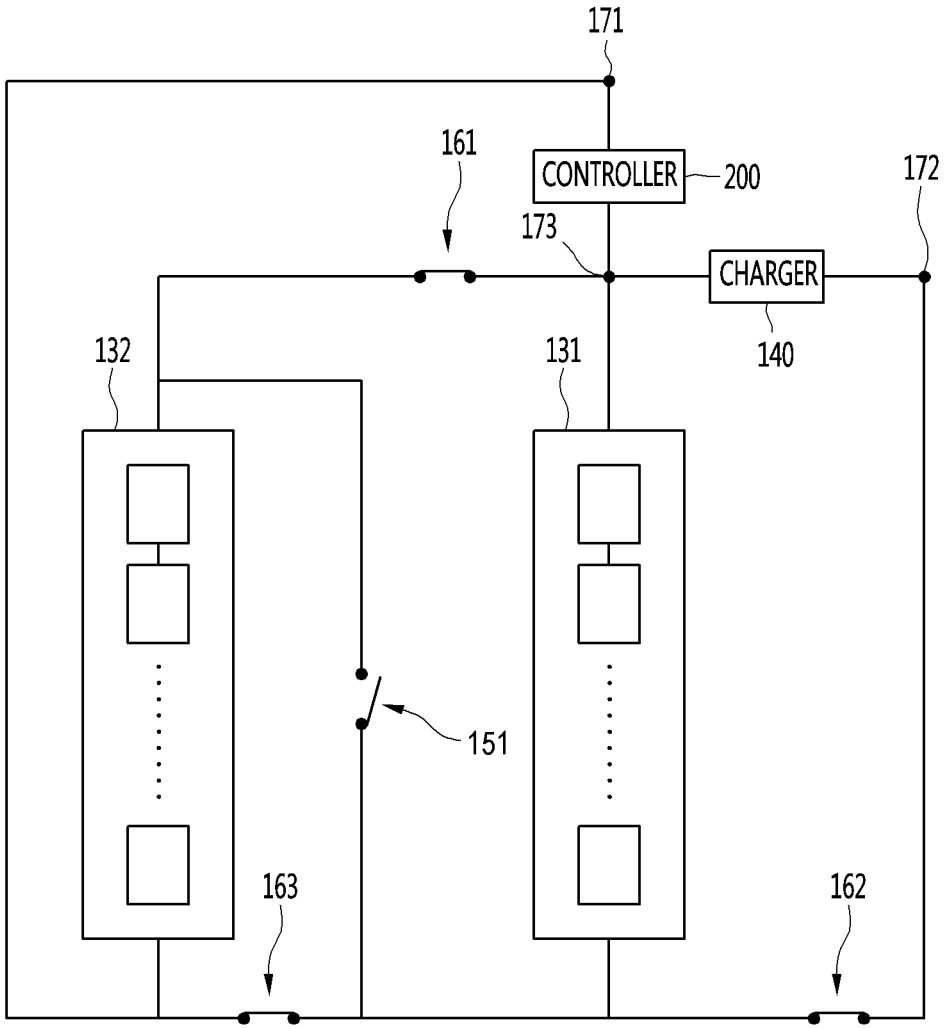
FIG. 8 is a view illustrating a state in which the plurality of battery packs are connected in parallel to each other in a state in which the plurality of battery packs are mounted on the cleaner body.

FIG. 8 is a view illustrating a state in which the plurality of battery packs are connected in parallel to each other in a state in which the plurality of battery packs are mounted on the cleaner body.

Referring to FIGS. 3 and 8, a first mode (or a parallel mode) of operating modes (or connection modes of the battery pack) of the cleaner body 10 may be selected by using the user interface 220.

The first mode may be a long time available mode.

When the first mode is selected, the controller 200 may control the switching mechanism 150 so that the plurality of battery packs 131 and 132 are connected in parallel to each other.

Particularly, the controller 200 may turn off the first switching mechanism 151 and turn on the second switching mechanisms 161, 162, and 163.

Thus, the plurality of battery packs 131 and 132 may be connected in parallel to the controller 200 and/or the charger 140.

When the plurality of battery packs 131 and 132 are connected in parallel to the controller 200, an operation time of the suction motor 210 may increase. That is, the more the number of battery packs 131 and 132 connected in parallel to the cleaner body 10 increases, the more the operation time of the suction motor 210 may increase.

However, since residual voltages existing in the battery packs 131 and 132 are different in intensity, a diode for blocking a flow of the current in one direction to prevent the current from flowing from the battery pack having a high voltage to the battery pack having a low voltage may be provided.

In the state in which the first mode is selected, even though only a portion of the battery packs is mounted on the cleaner body 10, the cleaner body 10 may operate by the some battery pack.

Figure 9:
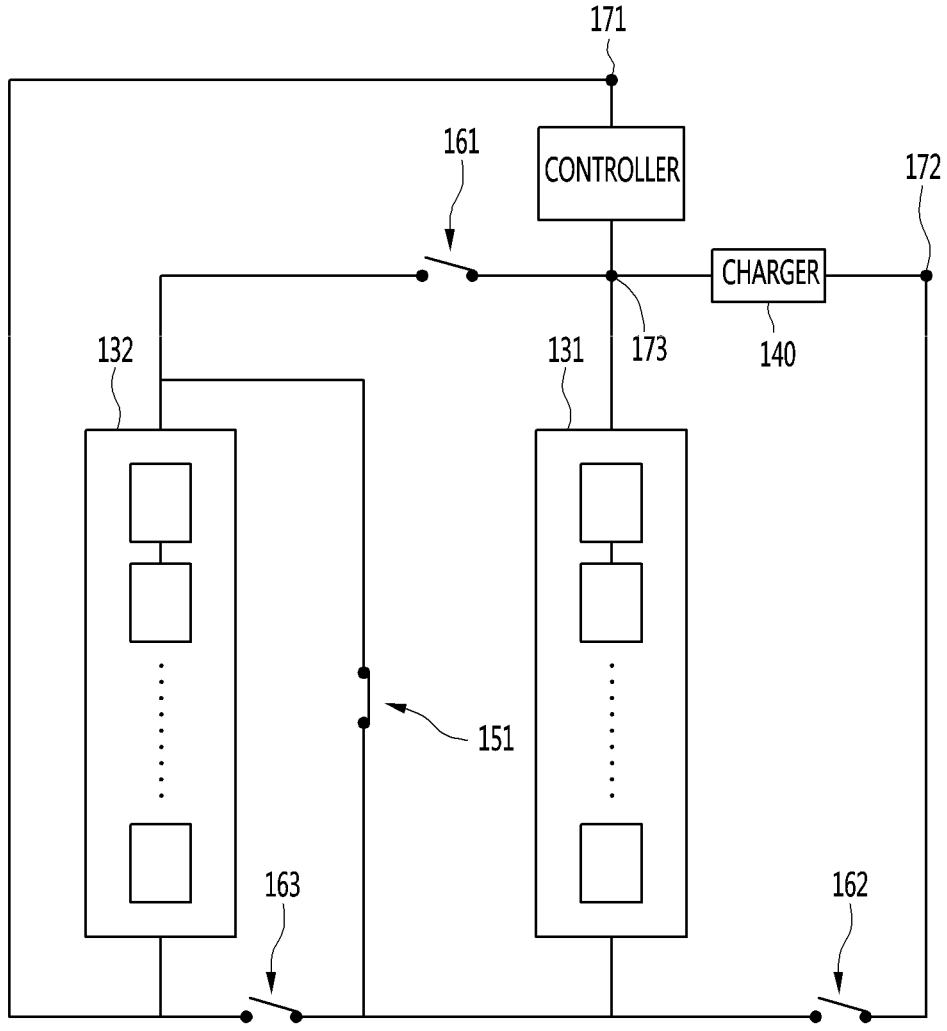
FIG. 9 is a view illustrating a state in which the plurality of battery packs are connected in series to each other in a state in which the plurality of battery packs are mounted on the cleaner body.

FIG. 9 is a view illustrating a state in which the plurality of battery packs are connected in series to each other in a state in which the plurality of battery packs are mounted on the cleaner body.

Referring to FIGS. 3 and 9, a second mode or a third mode of the operating modes (or connection modes of the battery pack) of the cleaner body 10 may be selected by using the user interface 220.

The second mode may be a high efficiency mode, and the third mode may be a high output mode. Each of the second mode and the third mode may be a serial connection mode of the battery pack.

When one of the second mode and the third mode is selected, the controller 200 may control the switching mechanism 150 so that the plurality of battery packs 131 and 132 are connected in series to each other.

Particularly, the controller 200 may turn on the first switching mechanism 151 and turn off the second switching mechanisms 161, 162, and 163.

Thus, the plurality of battery packs 131 and 132 may be connected in series to the controller 200 and/or the charger 140.

When the plurality of battery packs 131 and 132 are connected in series to each other, the voltage of the plurality of battery packs 131 and 132 may be greater than that of one battery pack.

Here, in the second mode, the current applied to the suction motor 210 may be regulated by the current regulating unit 202. That is, the current applied to the suction motor 210 by the current regulating unit 202 to correspond to the increasing voltage of the battery pack so that the suction motor 210 outputs a fixed output may be less than that applied to the suction motor when one battery pack is used.

When the suction motor 210 is driven, the operation efficiency may increase at the high voltage rather than the low voltage. According to an embodiment, when the current is regulated by the current regulating unit 202 in the state in which the plurality of battery packs 131 and 132 are connected in series to each other, the operation efficiency may be improved when compared with the case in which the plurality of battery packs 131 and 132 are connected in parallel to each other. Thus, the available time (the operation time of the suction motor) of the battery packs 131 and 132 may increase.

In the third mode, the current regulation (reduction of the current) by the current regulating unit 202 may not be performed. That is, the current that is substantially the same as that applied to the suction motor when one battery pack is used or when the plurality of battery packs are connected in parallel to each other and then used may be applied to the suction motor 210.

In this case, since the voltage increases by the serial connection of the plurality of battery packs 131 and 132 in the state in which the current is constantly maintained, the output of the suction motor 210 may increase.

Alternatively, the current regulating unit 202 may be omitted. In this case, only the first mode and the third mode may be performed.

In the case of this embodiment, when the second mode or the third mode is selected, all of the plurality of battery packs 131 and 132 have to be mounted on the cleaner body. If the second mode or the third mode is selected in the state in which all of the plurality of battery packs 131 and 132 are not mounted on the cleaner body, notification information or error information for additional mounting of the battery pack may occur in the user interface 220.

In order to charge the plurality of battery packs 131 and 132 in the state in which the plurality of battery packs 131 and 132 are connected to the cleaner body 10, the controller 200 may control the switching mechanism 150 so that the plurality of battery packs 131 and 132 are connected in parallel to each other. Here, the state of the switching mechanism 150 is as illustrated in FIG. 9.

Although the two battery packs are connected in parallel or series to each other in the abovementioned embodiment, on the other hand, three or more battery packs may be connected parallel or series to each other. The battery packs may be individually replaced regardless of the number of battery units.

Although a canister-type cleaner is described as an example of the cleaner, the idea of the present invention may be applied to an upright-type cleaner.

The above-disclosed subject matter is to be considered illustrative, not restrictive, and the appended claims are intended to cover all such modifications, enhancements, and other embodiments, which fall within the true spirit and scope of the present disclosure. Thus, the embodiment of the present invention is to be considered illustrative, and not restrictive, and the technical spirit of the present invention is not limited to the foregoing embodiment.

The invention claimed is:

1. A vacuum cleaner comprising:

a cleaner body comprising a suction motor configured to generate suction force, the cleaner body being configured to operate in an operating mode and a charging mode;

a suctioning part configured to communicate with the cleaner body to suction air and dust;

a battery assembly configured to supply power to the suction motor, the battery assembly comprising a plurality of battery packs;

a controller configured to control operation of the suction motor;

a current regulating unit configured to regulate current applied to the suction motor in a state in which the plurality of battery packs are connected in series to each other;

a first switching mechanism configured to serially connect the plurality of battery packs to each other; and a second switching mechanism configured to connect the plurality of battery packs to each other in parallel, wherein the operating mode comprises a plurality of modes, wherein the controller is configured to control one or more of the first switching mechanism, the second switching mechanism, and the current regulating unit based on a selected mode among the plurality of modes, and wherein the plurality of battery packs comprise a first portion that is fixed to the cleaner body and a second portion that is configured to separate from the cleaner body.

2. The vacuum cleaner according to claim 1, wherein the plurality of modes comprises a first mode, a second mode, and a third mode, and wherein the controller is configured to:

in the first mode, turn off the first switching mechanism and turn on the second switching mechanism, in the second mode, turn on the first switching mechanism, turn off the second switching mechanism, and regulate the current applied to the suction motor, and in the third mode, turn on the first switching mechanism, turn off the second switching mechanism, and restrict operation of the current regulating unit.

3. The vacuum cleaner according to claim 2, further comprising a user interface configured to enable selection of one mode of the plurality of modes, wherein the plurality of battery packs are configured to be connected in parallel or in series to each other by a command inputted by the user interface.

4. The vacuum cleaner according to claim 3, wherein the user interface is configured to, based on a portion of the plurality of battery packs not being mounted on the cleaner body in the second mode or the third mode, provide notification information or error information of the battery packs.

5. The vacuum cleaner according to claim 4, wherein the user interface is configured to, based on a portion of the plurality of battery packs not being mounted on the cleaner body in the second mode or the third mode, provide the notification information and the error information of the battery packs.

6. The vacuum cleaner according to claim 2, wherein the controller is configured to, in the second mode, control the current regulating unit to reduce the current applied to the suction motor relative to a current value that is applied to the suction motor based on one battery pack being mounted.

7. The vacuum cleaner according to claim 2, wherein the controller is configured to, in the third mode, maintain the current applied to the suction motor.

8. The vacuum cleaner according to claim 2, wherein the second switching mechanism comprises:

a first switch configured to connect a negative electrode terminal to first ends of the plurality of battery packs or to block connection between the negative electrode terminal and one battery pack of the plurality of battery packs;

a second switch configured to connect second ends of the plurality of battery packs to a positive electrode terminal for charging or to block connection between the positive electrode terminal and the second ends of the plurality of battery packs; and a third switch configured to connect the second ends of the plurality of battery packs to each other or to block connection between the second ends of the plurality of battery packs.

9. The vacuum cleaner according to claim 2, wherein each of the plurality of battery packs comprises a diode that is configured to, in the first mode, block flow of current from one battery pack having a high voltage to another battery pack having a low voltage.

10. The vacuum cleaner according to claim 1, further comprising a charger provided in the cleaner body and configured to charge at least a portion of the plurality of battery packs.

11. The vacuum cleaner according to claim 1, wherein the first portion of the plurality of battery packs comprises a first battery pack that is fixed to the cleaner body and that has a first charging capacity; and wherein the second portion of the plurality of battery packs comprises a second battery pack that is configured to separate from the cleaner body and that has a second charging capacity less than the first charging capacity.

12. The vacuum cleaner according to claim 1, wherein each of the battery packs comprises a plurality of battery cells, and wherein a number of battery cells of a first battery pack that is fixed to the cleaner body is greater than a number of battery cells of a second battery pack configured to separate from the cleaner body.

13. The vacuum cleaner according to claim 1, further comprising:

a mounting part that is configured to individually mount the plurality of battery packs on the cleaner body; and a mounting guide disposed at the mounting part and configured to guide mounting of each of the plurality of battery packs.

14. The vacuum cleaner according to claim 13, wherein the plurality of battery packs mounted on the mounting part are spaced apart from each other by the mounting guide.

15. A vacuum cleaner comprising:

a cleaner body configured to operate in a plurality of modes, the cleaner body comprising a suction motor configured to generate suction force;

a suctioning part configured to communicate with the cleaner body and to suction air and dust;

a plurality of battery packs configured to supply power to the suction motor, the plurality of battery packs comprising a first battery pack and a second battery pack;

a controller configured to control operation of the suction motor;

a current regulating unit configured to regulate current applied to the suction motor;

a first switching mechanism configured to serially connect the plurality of battery packs to each other; and a second switching mechanism configured to connect the plurality of battery packs to each other in parallel, wherein the controller is configured to control at least one of the first switching mechanism, the second switching mechanism, or the current regulating unit based on a mode selected from the plurality of modes, and wherein the second switching mechanism comprises:

a first switch that is configured to connect a first electrode terminal to a first end of the second battery pack and to disconnect the first electrode terminal from the first end of the second battery pack, the first electrode terminal being connected to a first end of the first battery pack, a second switch that is configured to connect a second electrode terminal to second ends of the first battery pack and the second battery pack and that is configured to disconnect the second electrode terminal from the second ends of the first battery pack and the second battery pack, and a third switch that is configured to connect the second end of the first battery pack to the second end of the second battery pack and that is configured to disconnect the second end of the first battery pack from the second end of the second battery pack.

16. The vacuum cleaner according to claim 15, further comprising a charger configured to charge at least one of the plurality of battery packs, the charger having the first electrode terminal and the second electrode terminal.

17. The vacuum cleaner according to claim 15, wherein the first switching mechanism comprises a serial switch having:

a first end connected between the first end of the second battery pack and the first switch; and a second end connected between the second end of the first battery pack and the third switch.

18. The vacuum cleaner according to claim 17, wherein the third switch is disposed between the second end of the second battery pack and the second end of the serial switch.

19. The vacuum cleaner according to claim 16, wherein the controller is connected to the first electrode terminal that is disposed between the charger and the first switch.

* * * * *